US008261388B1

(12) United States Patent
Gill et al.

(10) Patent No.: US 8,261,388 B1
(45) Date of Patent: Sep. 11, 2012

(54) HUMAN CUSHION APPARATUS

(76) Inventors: Zora S. Gill, Bakersfield, CA (US); Nichhater Singh Gill, Bakersfield, CA (US)

( * ) Notice: Subject to any disclaimer, the term of this patent is extended or adjusted under 35 U.S.C. 154(b) by 102 days.

(21) Appl. No.: 12/454,310

(22) Filed: May 16, 2009

(51) Int. Cl.
*A47C 27/00* (2006.01)

(52) U.S. Cl. ..... 5/710; 5/713

(58) Field of Classification Search ..... 5/701, 710, 5/713, 706, 655.3
See application file for complete search history.

(56) References Cited

U.S. PATENT DOCUMENTS

| | | | | |
|---|---|---|---|---|
| 3,678,520 | A * | 7/1972 | Evans | 5/713 |
| 4,175,297 | A * | 11/1979 | Robbins et al. | 5/284 |
| 5,588,167 | A | 12/1996 | Palno | |
| 5,594,962 | A | 1/1997 | Bogdanoff | |
| 6,102,936 | A | 8/2000 | Augustine | |
| 6,119,292 | A | 9/2000 | Haas | |
| 6,163,908 | A | 12/2000 | Vrzalik | |
| 6,378,152 | B1 | 4/2002 | Washburn | |
| 6,473,920 | B2 | 11/2002 | Augustine | |
| 6,502,259 | B2 | 1/2003 | Chang | |
| 6,647,571 | B2 | 11/2003 | Hynansky | |
| 6,681,427 | B2 | 1/2004 | Anderson | |
| 6,695,798 | B2 | 2/2004 | Chang | |
| 6,910,238 | B2 | 6/2005 | Biggie | |
| 6,928,681 | B1 * | 8/2005 | Stacy | 5/713 |
| 7,069,610 | B1 | 7/2006 | Chai | |
| 7,086,104 | B1 | 8/2006 | Tsay | |
| 7,191,482 | B2 | 3/2007 | Romano | |
| 7,219,380 | B2 | 5/2007 | Beck | |
| 7,308,725 | B2 | 12/2007 | Cazzini | |
| 2004/0222611 | A1 | 11/2004 | Fenwick | |
| 2005/0022308 | A1 * | 2/2005 | Totton et al. | 5/713 |
| 2007/0006388 | A1 | 1/2007 | Townsend | |
| 2007/0033738 | A1 | 2/2007 | Tu | |
| 2007/0094806 | A1 | 5/2007 | Beretta | |
| 2007/0209119 | A1 | 9/2007 | Chun-Chu | |

* cited by examiner

*Primary Examiner* — Fredrick Conley
(74) *Attorney, Agent, or Firm* — Dennis W. Beech

(57) ABSTRACT

The present invention may be used for support of a human on a cushion. A mattress apparatus may have a base member of generally rectangular shape with four upstanding peripheral side walls. A plurality of bars may be disposed on the base member in a rectangular matrix configuration and the plurality of bars may have a separation space longitudinally and laterally between adjacent bars. A gas member of generally elongated tubular shape may be positioned longitudinally in each of the longitudinal separation spaces with each of the gas members having a gas conduit connected to a first pressurized gas source. Lateral gas tubes that may be of generally rectangular shape may be positioned transversally of the longitudinal gas tubes with a first end of each lateral gas tube connected to the first pressurized gas source or to a second pressurized gas source. A bed sheet covering the base member to enclose the top of the mattress apparatus.

18 Claims, 4 Drawing Sheets

HUMAN CUSHION APPARATUS

BACKGROUND OF THE INVENTION

This invention relates to apparatus and methods for support of a person or patient in a bed or other body support device. The new apparatus may have a generally rigid, semi-ridged or resilient bar support matrix on a base element that may have four side walls. There may be gas inflatable longitudinal gas tubes positioned in separation spaces between the bars, and there may be gas inflatable lateral gas tubes positioned over the bars and the longitudinal gas tubes.

A variety of beds and mattresses may be known for use by medical patients, immobile persons and persons needing cushion support; however, bed sores remain defiant and continue to develop and rest or sleep disorders are still a problem. Treatment of bed sores after they develop may be very difficult to treat and may fail to heal or may re-occur in many or a majority of cases. Various mattresses with inflatable cushions, chambers and tubes as well as sand blowing sacks, water beds and the like may be known. Mattresses that may have resilient support blocks on a platform surface may also be known. These mattresses may be very complex, difficult to use and clean and otherwise prove to be generally unusable by care givers and the general public. They may also not help users a majority of the time because they may not effectively remove pressure to a desired level and duration to inhibit skin and deep tissue damage or provide adequate cushioned support.

SUMMARY OF THE INVENTION

The present invention is directed to apparatus for support of a human on a cushion. A mattress apparatus may have a base member of generally rectangular shape with four upstanding peripheral side walls. A plurality of bars may be disposed on the base member in a rectangular matrix configuration and the plurality of bars may have a separation space longitudinally and laterally between adjacent bars. A gas member of generally elongated tubular shape may be positioned longitudinally in each of the longitudinal separation spaces with each of the gas members having a gas conduit connected to a first pressurized gas source. Lateral gas tubes that may be of generally rectangular shape may be positioned transversally of the longitudinal gas tubes with a first end of each lateral gas tube connected to the first pressurized gas source or to a second pressurized gas source. A bed sheet may be used to cover the base member to enclose the top of the mattress apparatus.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
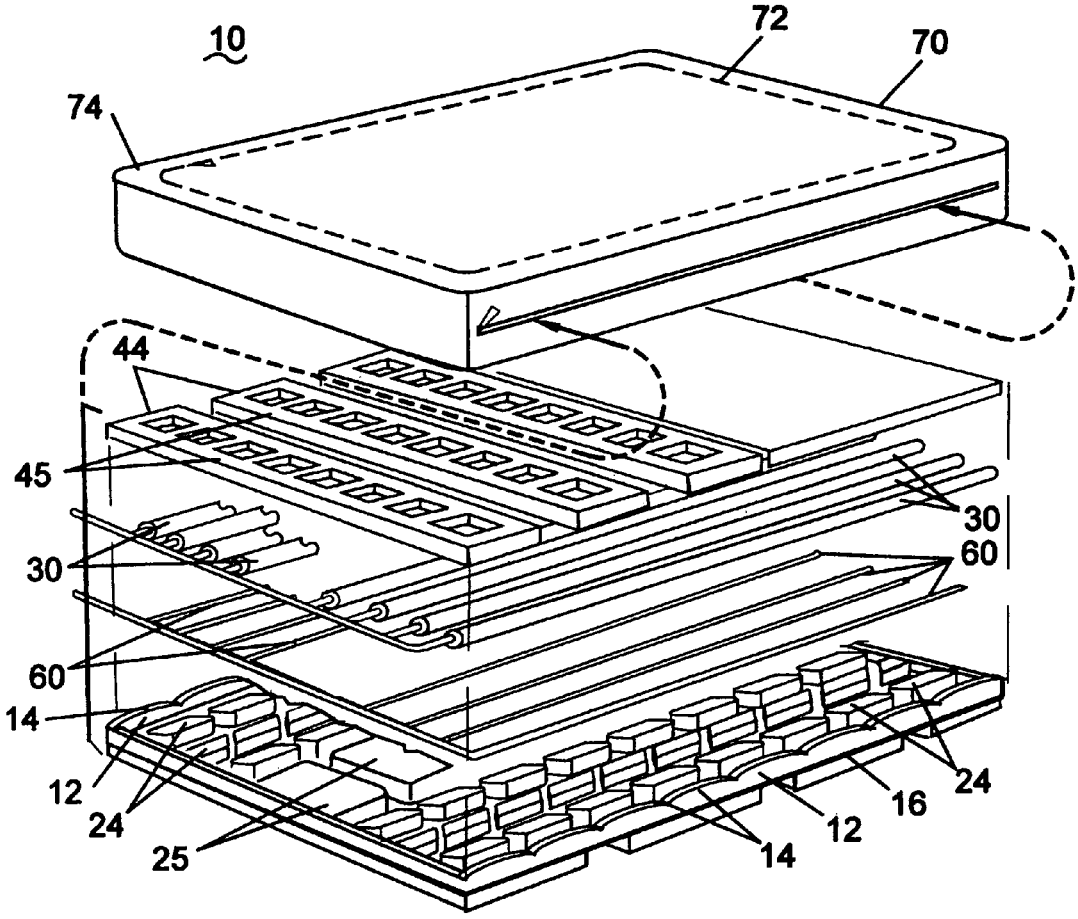
FIG. 1 illustrates a side perspective exploded view of a human cushion apparatus according to an embodiment of the invention.
Figure 2:
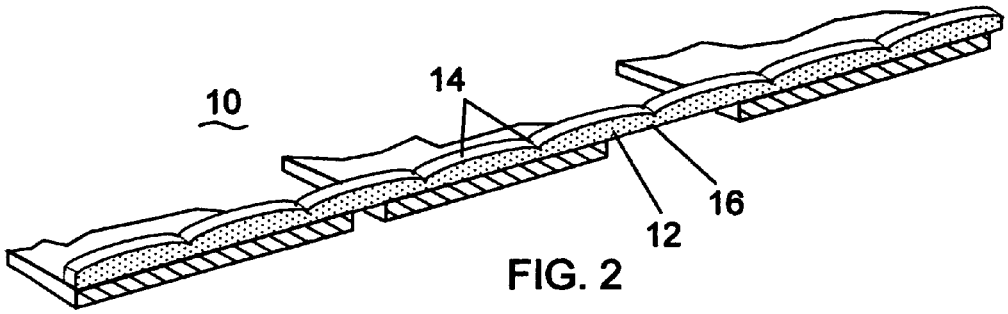
FIG. 2 illustrates a side partial perspective view of a human cushion apparatus according to an embodiment of the invention.
Figure 3:
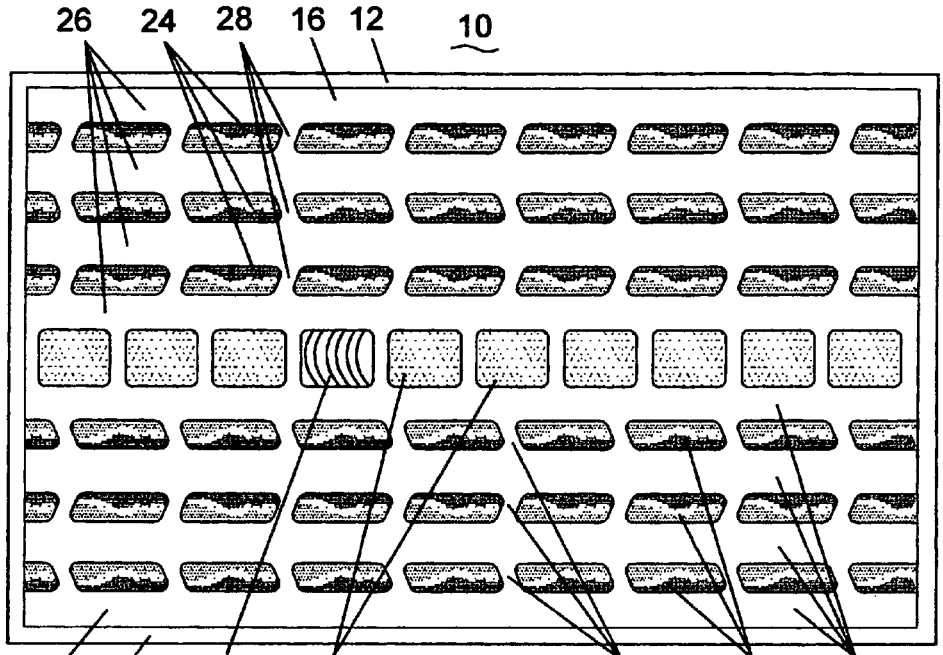
FIG. 3 illustrates a top plan view of a human cushion apparatus according to an embodiment of the invention.
Figure 4:
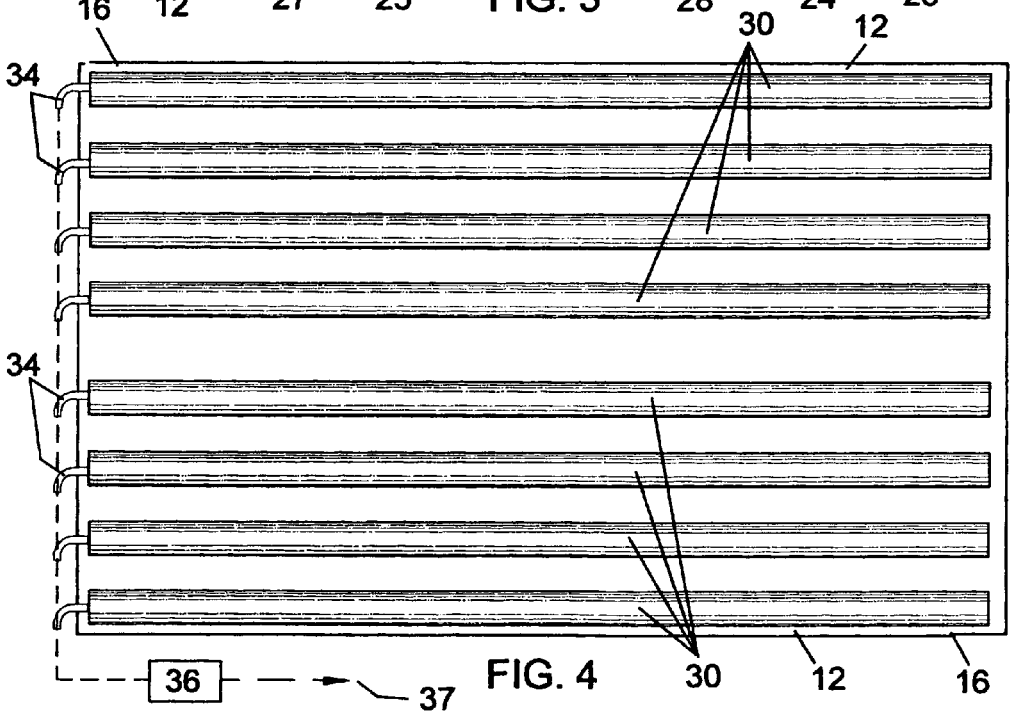
FIG. 4 illustrates a top plan view of longitudinal gas members in a human cushion apparatus according to an embodiment of the invention.
Figure 5:
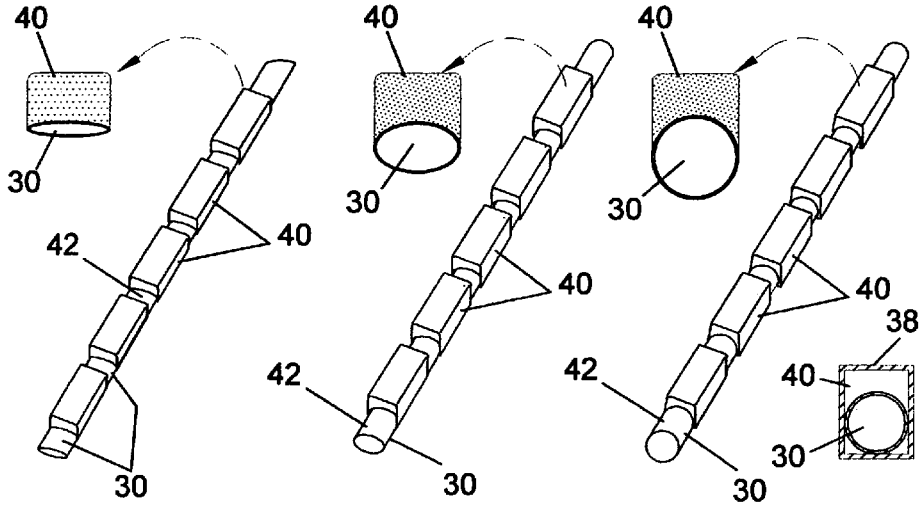
FIG. 5 illustrates a perspective and cross-sectional view of longitudinal gas members with tube blocks attached according to an embodiment of the invention.
Figure 6:
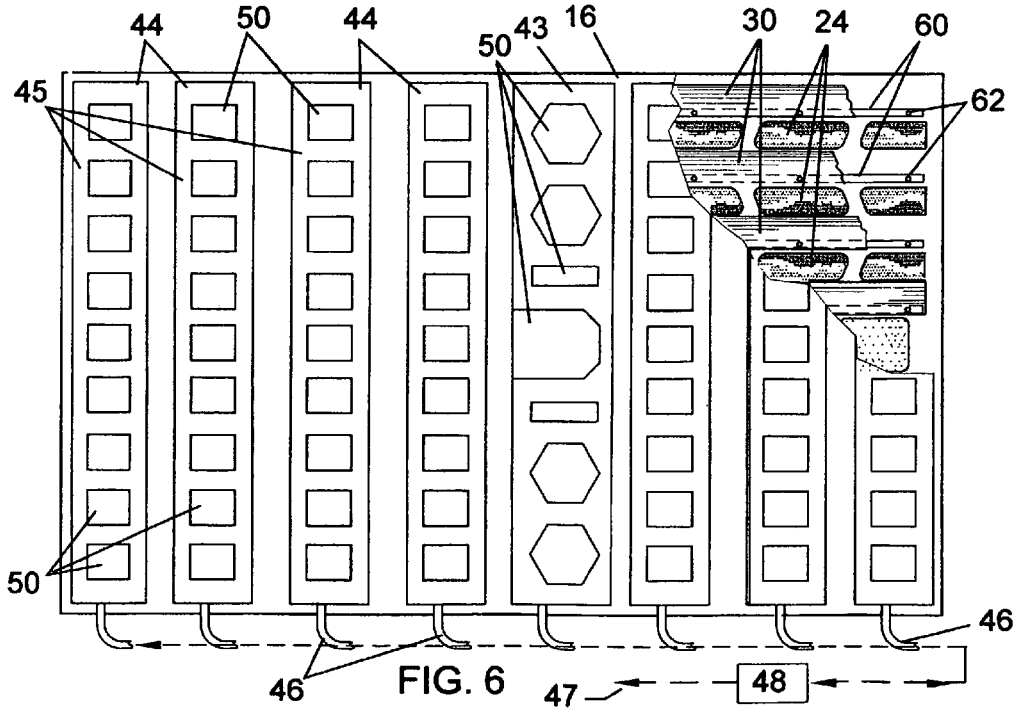
FIG. 6 illustrates a top plan view of lateral gas tubes in a human cushion apparatus according to an embodiment of the invention.
Figure 7:
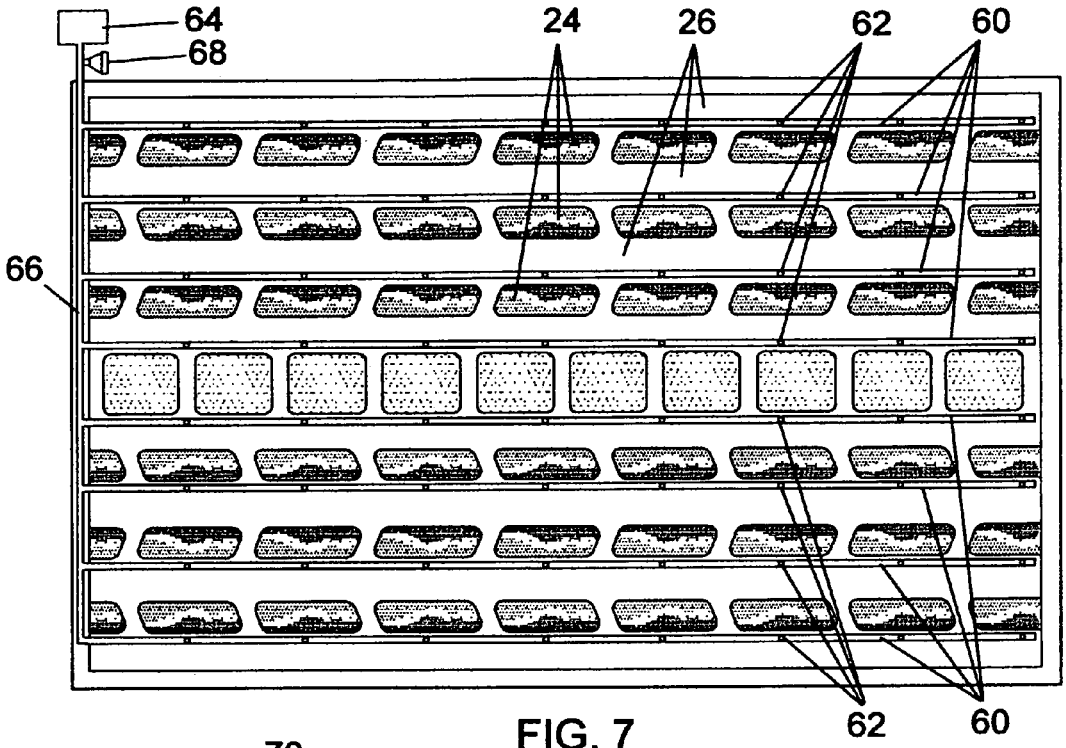
FIG. 7 illustrates a top plan view of flexible tubes in a human cushion apparatus according to an embodiment of the invention.
Figure 8:
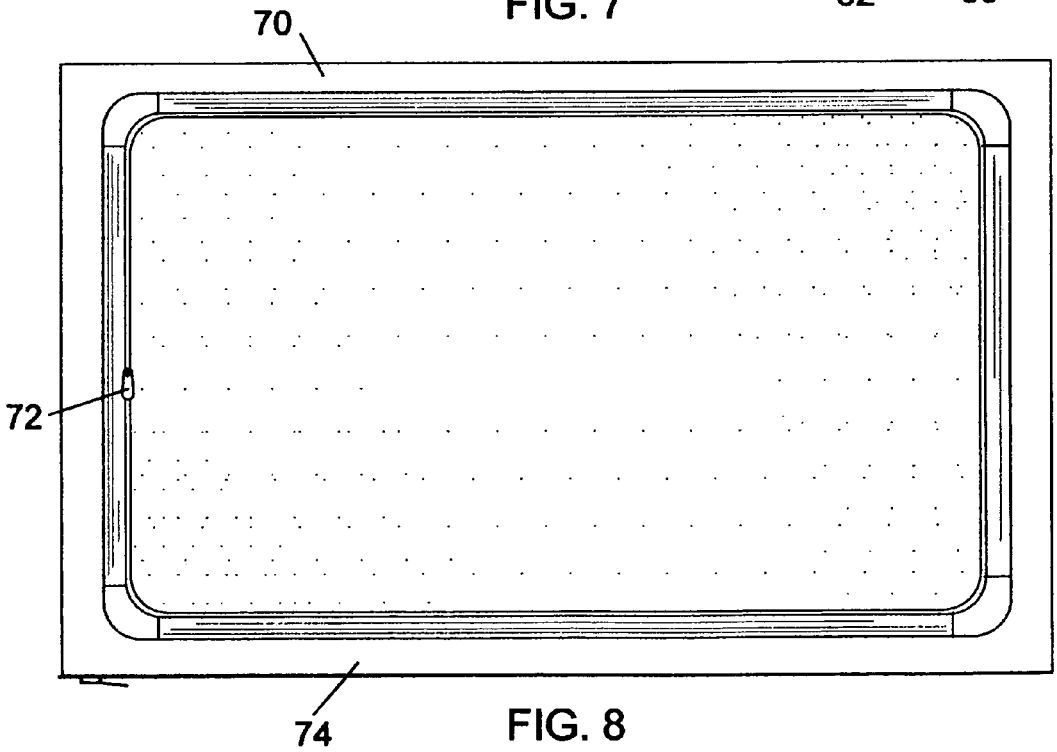
FIG. 8 illustrates a top plan view of a bed sheet with sheet attached according to an embodiment of the invention.

Referring to FIGS. 1 through 3, a mattress apparatus 10 may be of generally rectangular shape and be sized to fit on a standard bed frame or hospital bed frame (not shown). While a bed mattress may be used to disclose the apparatus, other configurations of mattresses or cushions such as for chairs, gurneys, operating tables, vehicle seats (automobiles), and the like may use the apparatus structure when sized for such applications. The number of bars 24, gas members 30 and lateral gas tubes 44 may vary based on the application. The mattress apparatus 10 may have a base member 16 or floor with peripheral side walls 12. The side walls 12 and base member 16 may be formed of foam, rubber, sponge, or like material that may be generally resilient to function as a support cushion type structure. The top surface 14 of the side walls 12 may have vertical breaks, slits or indentations to allow flexibility of the mattress apparatus 10. The side walls 12 may be approximately 2 inches wide and 2 inches tall; however, both may vary depending on application. The size of the mattress apparatus 10 may depend on the size of the bed frame or other cushion support structure. The base member 16 may be two or more inches thick and may have a porous structure for ease of cleaning and drying. The side walls 12 may have openings to accommodate gas tube insertion into the mattress for inflation or other purposes.

The mattress apparatus 10 may have a matrix of upwardly extending bars 24 that may generally have the form of a rectangular box or brick shape or imperfect diamond shape disposed on the base member 16. The bars 24 may be arranged in rows and columns having separation or space 26 between each of approximately 2 to 3 inches, but may vary further depending on a particular application. The bars 24 may also be approximately 2 to 3 inches in height and width, but may vary further depending on a particular application. The bars 24 may be formed of foam, rubber, sponge, gel or like material that may be generally resilient to function as a support cushion type structure. The bars may also be formed with a base of rigid material such as wood, metal and the like with a cushion material attached on top of the base. The bars 24 may be formed or molded with the base member 16, or otherwise attached. The bars 24 may be 6 to 8 inches long with additional length variations depending on the mattress structure and the application. A central longitudinal row 25 of bars 24 may be approximately 4 inches wide or wider by 6 to 8 inches long or longer depending on location and the cushion application. The central row 25 of bars 24 may have one or more bars 27 hollowed, troughed, reduced in height or recessed to accommodate bony prominences of a user's body.

Referring to FIGS. 1 through 5, a gas member 30 in the form of an elongated tube or bar shape that may be constructed of rubber, plastic or like material may be disposed longitudinally in the mattress apparatus 10 in the space 26 between the bars 24. The gas members 30 may have a gas conduit 34 attached at one end for connection to a pressurized gas source 36, for example, air, for inflating the gas members 30 that may be longitudinal gas tubes 30 and may have a gas exhaust port 37 controlled by gas source 36 for deflation of the gas tubes 30.

The longitudinal gas tubes 30 may be formed of a flexible, elastic material that defines a gas tight enclosure. The gas tubes 30 may have bars 40 similar to bars 24 attached on an upper surface 42 of the gas tubes 30. The attachment surface of the bars 40 may be shaped to conform to the upper surface 42 when the gas tubes 30 may be inflated. The bars 40 may be attached to the gas tubes 30 spaced to span the lateral spaces 28 between the bars 24. To maintain orientation and reduce interference between bars 24 and bars 40 as bars 40 may be raised and lowered as the gas tubes 30 may be raised and lowered as the gas tubes 30 may be inflated, cooperating projections 38 or sleeves may be attached to the bars 24, 40. Placing the gas tubes 30 between bars 24 may inhibit mushrooming of the gas tubes 30. The gas tubes 30 may be inflated to raise bars 40 approximately 2.5 inches or higher to elevate them above the fixed bars 24 to change pressure support on a user's body. The gas tubes 30 may be hollow cylindrical shape or other cross-sectional form such as rectangular, oval or multifaced.

Referring to FIGS. 1 through 6 lateral gas tubes 44 that may be of generally elongated rectangular form or other suitable shape may be positioned on the bars 24 and the longitudinal gas tubes 30 with bars 40 depending on the pressure condition of the longitudinal gas tubes 30. The lateral gas tubes 44 may have a gas conduit 46 connected to a pressurized gas source 48 and an exhaust port 47 controlled by gas source 48 for inflating and deflating the gas tubes 44. The lateral gas tubes 44 may be formed of a flexible, elastic material that defines a gas tight enclosure. The lateral gas tubes 44 may have an upper support surface 45 that may be relatively broader than the upper surface 42. The gas tubes 44 may be approximately 6 inches wide or wider and inflate approximately 2 to 3 inches in height. The gas tubes 44 may collapse to a thin height profile and be approximately the length of the width of the mattress apparatus 10. The gas tubes 44 may be spaced approximately 4 inches or more apart. An approximately central lateral gas tube 43 may be approximately 8 inches wide and may inflate to approximately 2 to 3 or more inches in height. The gas tube 43 may have various size and shape apertures 50 to accommodate bony prominences, such as sacrum, trochanters and ischial bones, of user's bodies. The gas tubes 44 may also have apertures 50 that may be rectangular or other form. The gas tubes 43, 44 may be removably attached by hook and loop or other fasteners.

In use, the mattress apparatus 10 may have each of the tubes 30, 43, 44 connected to the same or a separate controllable gas source, such that each tube 30, 43, 44 may be inflated and deflated independently. Other embodiments may have groups of tubes 30 or 43, 44 connected to a controllable gas source. For example, the longitudinal gas tubes 30 may be alternately connected to a common gas source to allow inflating and deflating the tubes 30 in an alternating method for therapy of a patient, such as to reduce the formation of bed sores. The tubes 30 may also be connected to a gas source with the outer tubes 30 controllable independent of the interior tubes 30. This may aid in moving a patient back and forth in a bed. The lateral gas tubes 43, 44 may also be connected in groups to a controllable gas source, for example, the tubes 44 located under the upper torso of a patient may be controlled separately from the tubes 44 located under the lower body or leg portion of a patient. The tubes 30 and lateral gas tubes 43, 44 may be inflated and deflated for 15 minutes to 4 hours or more to allow maximizing relief to body pressure areas and to improve sleeping to users.

Referring to FIGS. 1 through 7, the mattress apparatus 10 may have flexible tubes 60, formed of for example plastic, placed longitudinally in the space 26 between the bars 24 adjacent the gas tubes 30. The tubes 60 may have a diameter of approximately ½ inch. The tubes 60 may have graduated size gas apertures 62 proportional based on distance from a gas pressure source 64 to facilitate relatively even gas escape flow along the lengths of the tubes 60. The tubes 60 may be connected to a supply tube 66 of approximately % to 2 inches diameter that may be connected to the gas pressure source 64 and that may be positioned at one end of the mattress apparatus 10.

The gas pressure source 64 may be an air flow fan that may be electronically controlled and that may deliver ambient, cool or warm air. There may be a fluid container 68 attached to the supply tube 66 for containing fluids to be entrained with the gas flow. This may allow use of perfumes, aromatic oils, water and the like. This may mask odors and supply moisture to the mattress apparatus 10 and may keep portions of a user's body free from sweat and body fluids.

Referring to FIGS. 1 through 8, a bed sheet 70 may be positioned over the base member 16 and elements positioned therein to present the appearance of a standard mattress. The bed sheet 70 may be formed or coated for hydrophobic and friction reducing properties. The bed sheet 70 may also have antimicrobial properties and the like hygienic and health properties in the material. The bed sheet 70 may be in the form of an enclosed casing that may be closed with a zipper or other closure. There may be a sheet 72 detachably attached to the upper surface 74 of the bed sheet 70 to approximately cover the upper surface 74. The sheet 72 may be relatively thick, soft and airy as well as porous and non-abrasive. The sheet 72 may be thick enough to reduce the user's sensing of the deflated apparatus 10 and the bars 24. A suitable material may be lamb wool, cotton or like material. The sheet 72 may be attached by zipper, hook-and-loop or other suitable fastener. The bed sheet 70 may have attached straps or other attachment devices to attach the mattress apparatus 10 to a bed frame or other structure.

While the invention has been particularly shown and described with respect to the illustrated embodiments thereof, it will be understood by those skilled in the art that the foregoing and other changes in form and details may be made therein without departing from the spirit and scope of the invention.

We claim:

1. An apparatus for support of a human on a cushion comprising:

a mattress apparatus having a base member of generally rectangular shape with four upstanding peripheral side walls;

a plurality of bars disposed on said base member arranged in rows and columns in a rectangular matrix configuration and said plurality of bars having a separation space longitudinally and laterally between adjacent bars;

a gas member of generally elongated tubular shape disposed longitudinally in each of said longitudinal separation spaces wherein each of said gas members having a gas conduit connected to a first pressurized gas source;

a plurality of lateral gas tubes of generally rectangular shape disposed transversally of said longitudinal gas tubes wherein a first end of each of said lateral gas tubes is connected to a second pressurized gas source; and a bed sheet disposed over said base member to cover an upper portion of said mattress apparatus.

2. The apparatus as in claim 1 wherein each of said gas members has a plurality of tube bars attached to an upper surface.

3. The apparatus as in claim 2 wherein said plurality of bars and said plurality of tube bars have cooperatively attached and disposed a plurality of projections on adjacent bars and tube bars to inhibit interference during raising and lowering of said tube bars.

4. The apparatus as in claim 2 wherein said tube bars are sufficient height to be elevated above the height of said bars by inflation of said gas members.

5. The apparatus as in claim 1 wherein a central longitudinal row of said bars has approximately at least twice the width of the remainder of said plurality of bars.

6. The apparatus as in claim 5 wherein at least one of said bars in said central longitudinal row has a reduced height relative to the remainder of said bars in said central longitudinal row.

7. The apparatus as in claim 1 wherein said first pressurized gas source and said second pressurized gas source each have an exhaust port.

8. The apparatus as in claim 1 wherein said four upstanding peripheral side walls have indentations in a top surface.

9. The apparatus as in claim 1 wherein:

a flexible tube is disposed in each of said longitudinal separation spaces adjacent to said gas members;

each of said flexible tubes has a gas aperture; and each of said flexible tubes is connected to a supply tube that is connected to a third gas pressure source.

10. The apparatus as in claim 9 wherein a fluid container is connected to said supply tube to allow entrainment of a fluid disposed in said fluid container.

11. The apparatus as in claim 1 wherein said bed sheet has a sheet detachably attached to an upper surface.

12. The apparatus as in claim 11 wherein said sheet has a thickness to reduce a user's sensing of said bars, said gas members and said lateral gas tubes.

13. The apparatus as in claim 1 wherein said bars are approximately 2 to 3 inches in height and width, approximately 6 to 8 inches long, and are spaced apart approximately 2 to 3 inches.

14. The apparatus as in claim 1 wherein said plurality of lateral gas tubes has a plurality of apertures therein and a central lateral gas tube of said lateral gas tubes has user body disposed apertures therein.

15. The apparatus as in claim 1 wherein said gas members are approximately 6 inches wide and inflatable to approximately 2 to 3 inches in height.

16. The apparatus as in claim 1 wherein said bed sheet generally encloses said mattress apparatus.

17. The apparatus as in claim 1 wherein said second gas source is actually said first gas source.

18. A method for relief of human body pressure areas using the apparatus of claim 1 comprising inflating and deflating said gas members and said lateral gas tubes for a period of time of 15 minutes to 4 hours.

* * * * *